United States Patent [19]

Aziz et al.

[11] 4,201,402

[45] May 6, 1980

[54] COMBINATION CHECKWRITING AND BOOKKEEPING ASSEMBLY AND METHOD OF USING SAME

[75] Inventors: Paul D. Aziz, West Hartford; Robert W. Hincks, Farmington, both of Conn.

[73] Assignee: Data Management, Incorporated, Farmington, Conn.

[21] Appl. No.: 957,050

[22] Filed: Nov. 7, 1978

Related U.S. Application Data

[63] Continuation-in-part of Ser. No. 869,572, Jan. 16, 1978, abandoned.

[51] Int. Cl.[2] ..... B41L 1/20; B41L 1/36

[52] U.S. Cl. ..... 282/9 A; 282/8 A; 282/8 C; 282/29 A; 282/29 B; 283/66 A

[58] Field of Search ..... 282/8 A, 8 C, 9 A, 29 A, 282/29 B; 283/66 A

[56] References Cited

U.S. PATENT DOCUMENTS

| | | | |
|---|---|---|---|
| 860,719 | 7/1907 | Winkelmann | 282/29 R |
| 1,799,367 | 4/1931 | Heisinger | 282/29 A |
| 2,253,917 | 8/1941 | Rogers | 282/9 |
| 2,381,197 | 8/1945 | Zalkind | 282/29 A |
| 2,749,032 | 6/1956 | Smusz | 282/29 A |
| 2,836,433 | 5/1958 | Dolan | 282/29 |
| 3,142,496 | 7/1964 | Rideout | 282/8 |
| 3,236,542 | 2/1966 | Russell | 282/29 |
| 3,290,061 | 12/1966 | Glassman | 282/23 |
| 4,097,066 | 6/1978 | Davis | 282/29 B |

FOREIGN PATENT DOCUMENTS

| | | | |
|---|---|---|---|
| 382746 | 10/1918 | Fed. Rep. of Germany | 282/29 A |
| 1261135 | 2/1968 | Fed. Rep. of Germany | 282/29 A |
| 70022 | 2/1946 | Norway | 282/29 A |

*Primary Examiner*—John McQuade

[57] ABSTRACT

A bookkeeping and check writing system enables simultaneous entry of payee and numerical disbursement amount upon the check and an underlying disbursement sheet and, when desired, a duplicate sheet such as a separable voucher sheet. The disbursement sheet has payee and numerical disbursement columns spaced cooperatively to the blanks appearing on standard commercial checks and a transfer sheet is secured in overlying position. A shield member is positioned upon the transfer sheet and supports a check thereon so that the payee and disbursement blanks are aligned with the columns of the disbursement sheet. The shield member has an aperture therein coinciding with the appropriate blanks so that, when the data is entered upon the check by a pen or the like, the pressure is transferred to the transfer sheet and any underlying sheets through the aperture in the shield member, whereas the body of the shield member absorbs the pressure of the writing implement as the remaining blanks of the check are completed.

18 Claims, 13 Drawing Figures

COMBINATION CHECKWRITING AND BOOKKEEPING ASSEMBLY AND METHOD OF USING SAME

CROSS-REFERENCE TO RELATED APPLICATION

The present application is a continuation-in-part of our copending application Ser. No. 869,572 filed Jan. 16, 1978, now abandoned and bearing the same title.

BACKGROUND OF THE INVENTION

Bookkeeping ledger systems require the entry of information concerning individual checks so that a complete record of disbursements is readily apparent. This generally requires completion of the check and subsequently the recordation of that data onto a ledger sheet, thus requiring a two-step operation and the opportunity for error to be made with respect to the numerical value of the check, the number of the check, etc. Moreover, substantial time is required for the two-stage operation and frequently can represent a problem for small businesses.

Heretofore it has been proposed to employ shingled checks in connection with a special base sheet and binder so that completion of the check will transfer data onto the underlying ledger sheet. This has required shingled checks provided with localized carbonized or "carbonless" coatings. Indicative of such structures is the apparatus shown in Russell U.S. Pat. No. 3,236,542 granted Feb. 22, 1966.

Another approach to minimize the possibility for erroneous entry of information is shown in Rideout U.S. Pat. No. 3,142,496 granted July 28, 1964, in which the checks are written upon a backing plate and are disposed in close proximity to the appropriate line of an underlying ledger sheet so that data may be immediately transferred to the ledger sheet.

Heretofore, Dolan U.S. Pat. No. 2,836,433, granted May 27, 1958, has proposed a template or mask which will permit simultaneous entry of date upon a top document supported upon the template and upon documents which underlie the template. However, to this date, there has not been developed any simple and effective bookkeeping and check writing system which would enable the facile and simultaneous entry to pertinent date upon both a check and upon the ledger sheet or the like.

It is an object of the present invention to provide a novel bookkeeping and check writing system which is relatively simple to fabricate and utilize and which enables simultaneous entry of payee and numerical amounts disbursed onto the check and onto underlying bookkeeping records.

It is also an object to provide such a system wherein the remainder of the check may be completed in the same position but other data is not recorded on the underlying bookkeeping records.

Another object is to provide such an assembly which enables utilization of standard commercial checks of either large or small size and which does not require any special shingling of the checks or treatment of the checks.

Still another object is to provide such a system in which individual check voucher slips may be simultaneously prepared so as to accompany the checks which are written.

A further object is to provide a method of check writing and bookkeeping wherein checks and bookkeeping records are simultaneously prepared and which method is simple and rapid so as to minimize the time required and the possibility of error.

A still further object is to provide such a method in which checks and vouchers may be made out concurrently with entries into the ledger sheets.

SUMMARY OF THE INVENTION

It has now been found that the foregoing and related objects can be readily attained in a bookkeeping and check writing system by a combination including a disbursement sheet having length and width dimensions, the width dimension providing a multiplicity of columns. Two columns are dimensioned cooperatively with commercial checks to record the name of the payee and the numerical amount entered on the checks. A transfer sheet of lesser width than the disbursement sheet is placed so as to overlie the two columns of the disbursement sheet, and suitable means releasably secured the transfer sheet in the overlying position.

A shield member has a check positioning portion disposed to one side of the transfer sheet and a shield portion extending therefrom above the disbursement sheet. The shield portion is of a length at least substantially equal to the portion of a check containing blanks for completion and has an elongated aperture therein extending transversely of the transfer sheet and across the above-mentioned two columns of the disbursement sheet. The positioning portion has an alignment indicium thereon aligned with the aperture and the shield member is adapted to position a check on the transfer sheet with its payee and numerical disbursement portions aligned with the indicium and thereby the two columns of the disbursement sheet on one of the lines thereof. The shield member is movable vertically from line to line thereof so that when a check is placed thereon and written, only the payee and numerical amount disbursed are entered on one line of the disbursement sheet.

In the preferred embodiment, the shield member includes a pair of positioning arms extending from the positioning portion and the shield and arms are positioned on opposite surfaces of the transfer sheet, and these positioning arms are spaced apart a distance greater than the portion of a check containing blanks for completion. The positioning arms overlie the transfer sheet to retain the shield member in position on the transfer sheet. The shield portion is of greater width than the transfer sheet and extends beyond the opposite side thereof, and that portion extending beyond the opposite side includes an alignment indicium aligned with the alignment indicium of the positioning portion.

Desirably, the shield member is transparent and slidable along the transfer sheet and disbursement sheet to bring the shield member into alignment with any one of the lines of the disbursement sheet. The shield member preferably has a clamping portion extending parallel to the columns and on the positioning portion thereof to receive and releasably retain one side edge of a check.

In one embodiment, the shield member is integrally formed from a strip of synthetic plastic sheet material with one side thereof being folded to provide the positioning portion including a clamping portion and abutment surface for one side edge of the check. In another embodiment, the shield member includes a base element providing the shield and positioning portions and a clamp element secured to the outer surface of the positioning portion providing an abutment surface and clamp for one side edge of the check.

The system may additionally include a duplicate sheet interposed between the transfer sheet and disbursement sheet, with the shield portion of the shield member extending between the transfer sheet and the duplicate sheet. This duplicate sheet may be severable transversely to provide voucher slips to be supplied with the checks corresponding to the entries thereon.

Most conveniently, the disbursement, duplicate and transfer sheets have reactive coatings on the opposed surfaces thereof, and these coatings are activated by the pressure of a writing implement to transfer the data entered on the associated check onto the disbursement sheet.

The method for simultaneously writing checks and recording data on the disbursement sheet involves a series of steps including providing the disbursement sheet and securing the transfer sheet over the two columns of the disbursement sheet. The shield member is positioned on the transfer sheet and disbursement sheet and moved vertically between the transfer and disbursement sheets to align its aperture with the line of the disbursement sheet onto which data is to be entered. A check is then positioned on the shield member so that its payee and numerical disbursement blanks are aligned with the aperture of the shield portion and the two columns of the disbursement sheet. Then the data is entered onto the check to complete at least the payee and numerical disbursement blanks thereof; simultaneously the data entered in the payee and numerical disbursement blanks is entered in the underlying two columns of said disbursement sheet with the shield portion substantially preventing recordation of other data entered onto the check.

In further steps, the first check is removed and the shield member is moved downwardly into alignment with another lie on the disbursement sheet. Another check is positioned on the shield member so that its payee and numerical disbursement blanks are aligned with the aperture of the shield portion and the two columns of said disbursement sheets.

Thereafter, data is entered onto this check to complete at least the payee and numerical disbursement blanks thereof with the data entered in the blanks being simultaneously entered in the underlying two columns of the disbursement sheet.

A duplicate sheet may be placed between the transfer sheet and disbursement sheet, so that the entering of data onto the check simultaneously enters the data on both the duplicate sheet and the disbursement sheet. The shield member and check may be removed to enter additional data onto the duplicate sheet with the data entered onto the duplicate sheet being simultaneously entered into the underlying columns of the disbursement sheet. The duplicate sheet may then be severed across its width to provide a strip containing data relative to the associated check.

DETAILED DESCRIPTION OF THE ILLUSTRATED EMBODIMENT

Figures 1, 2:
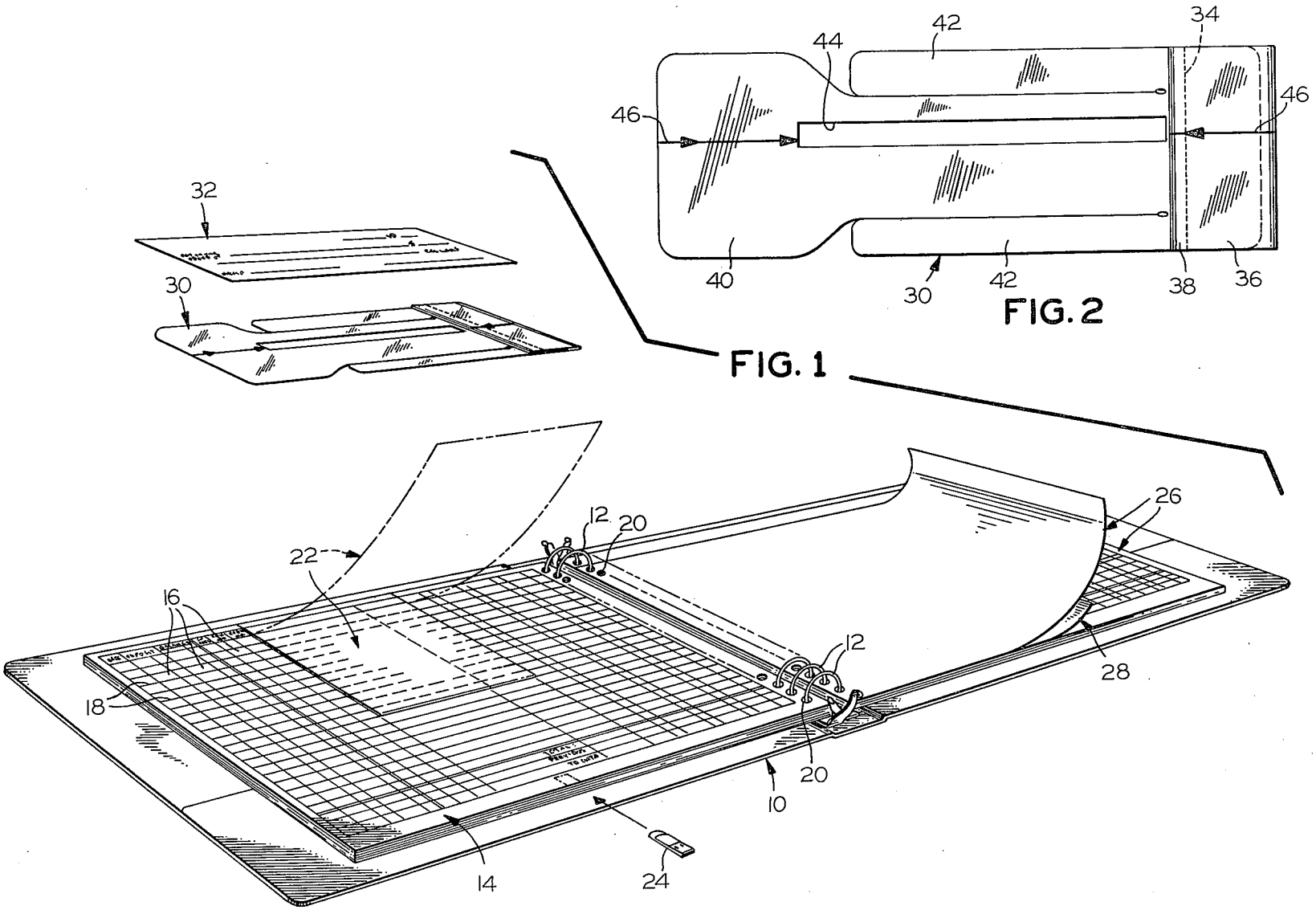
FIG. 1 is a partially exploded view of a bookkeeping system ledger assembly embodying the present invention with the shield member, check and clip shown in full line spaced from the remaining elements of the assembly, with the transfer sheet shown in folded position in full line and in phantom line in an unfolded, lifted position, and with a short disbursement sheet and voucher sheet shown on the right hand side of the ledger in partially lifted position.
FIG. 2 is a plan view of the shield member of the assembly of FIG. 1 drawn to an enlarged scale.

Turning first to FIG. 1 of the attached drawings, therein illustrated in partially exploded condition is a bookkeeping ledger assembly embodying the present invention and comprised of a binder generally designated by the numeral 10 including conventional rings 12. On the left hand side of the binder 10 is shown a disbursement sheet generally designated by the numeral 14 which has its width divided into a multiplicity of columns 16 and its length divided into a multiplicity of lines 18. Along one edge the disbursement sheet 14 is provided with perforations 20 which receive the rings 12 of the binder 10 so as to maintain it in assembly thereon.

Disposed on the exposed surface of the disbursement sheet 14 is a transfer sheet generally designated by the numeral 22 and of a length substantially equal to the length of the disbursement sheet 14. The transfer sheet 22 is shown in full line in a folded position for convenience of storage and is normally unfolded as seen in phantom line and secured to the bottom of the disbursement sheet 14 by a clip 24 or the like. Although a similar clip may be utilized to secure the upper edge portion of the transfer sheet 22 to the upper edge portion of the disbursement sheet 14, conveniently a tacky adhesive coating (not shown) is provided on the surface of the transfer sheet 22 to secure it to the disbursement sheet 14. Such an adhesive coating should be preferentially adherent to the transfer sheet 22 so that it is removed therewith when it is desired to effect disassembly.

On the right hand side of the ledger are shown additional disbursement sheets generally designated by the numeral 26 which are of shorter length than the disbursement sheet 14 so that the columnar headings of the disbursement sheet 14 will be exposed when the disbursement sheets 26 are in overlying position thereon. Also shown in partially lifted position is a voucher sheet generally designated by the numeral 28. All of the sheets 26, 28 are provided with perforations 20 through which the rings 12 of the binder 10 pass to maintain them in assembly within the binder 10.

Shown in spaced position above the left hand side of the binder 10 are the shield member generally designated by the numeral 30 and a commercially available check generally designated by the numeral 32.

Figure 3:
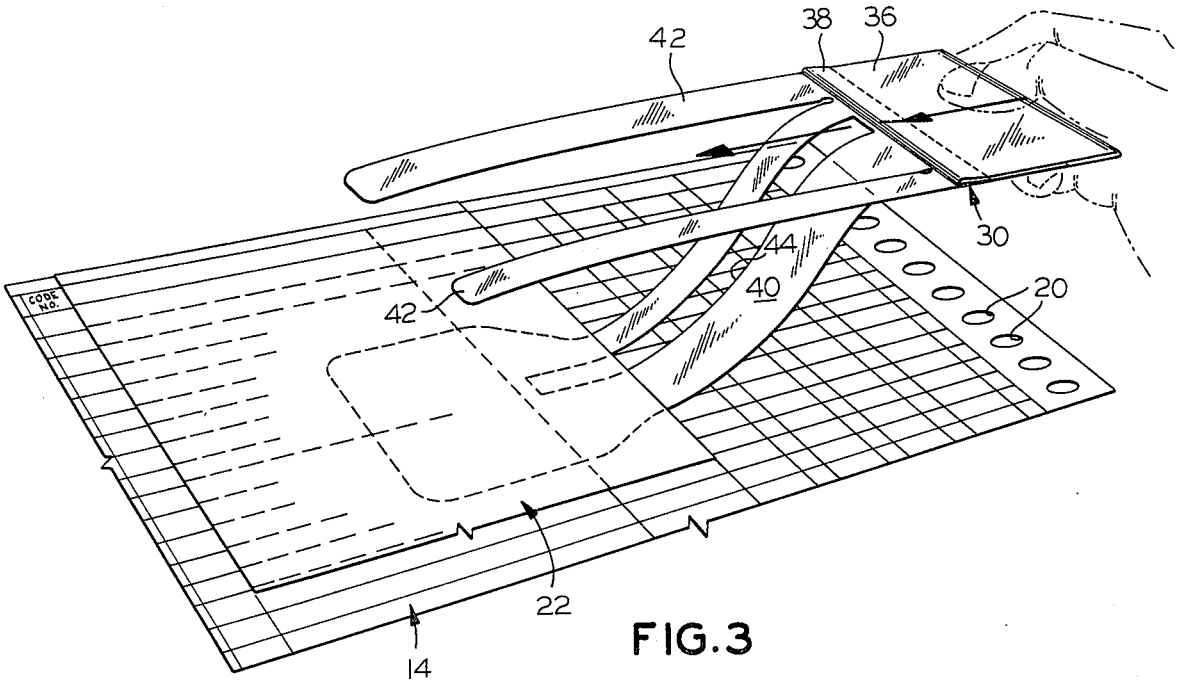
FIG. 3 is a fragmentary perspective view of a ledger sheet and transfer sheet subassembly with the shield member in the process of being inserted into operative position.

Turning now in detail to the structure of the shield member 30, this is best seen in FIGS. 2 and 3. In this embodiment, the shield member 30 is integrally formed from a strip of synthetic plastic sheet material which is reversely folded along its right hand margin and which then has the end portion of the overlying folded portion reversely folded inwardly so as to provide a three-ply structure as shown by the right hand dotted line in FIG. 2. The several plies are secured together by a line of heat sealing or the like 34, and this multi-ply structure then comprises the check positioning portion 36 providing an abutment clamp 38 to receive the edge portion of the check 32.

The remainder of the plastic sheet material is cut so as to provide the elongated shield portion 40 and the positioning arm portions 42, all of which are hingedly connected to the check positioning portion 36. The shield portion 40 is provided with an elongated aperture 44 therein and alignment indicia 46 are provided in alignment with the lower portion of the aperture 44 upon both the check positioning portion 36 and the shield portion 40 spaced to the opposite side of the aperture 44.

Figure 6:
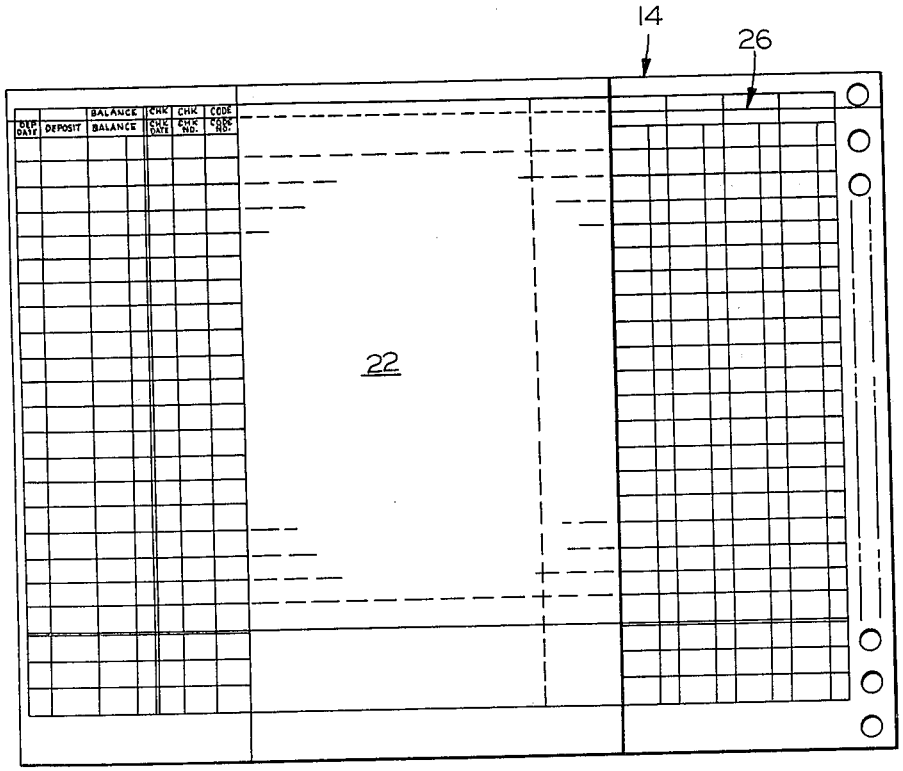
FIG. 6 is a plan view of the assembly of FIG. 1 with the short disbursement sheet pivoted over so as to overlie the disbursement sheet on the left hand side of FIG. 1.

Turning now to FIG. 6, a short disbursement sheet 26 is shown as overlying the base disbursement sheet 14 and it can be seen that its shorter length exposes the columnar headings upon the overlying base disbursement sheet 14. Moreover, the transfer sheet 22 can be seen to be secured to the base disbursement sheet 14 along a line sufficiently narrow in width to permit the short disbursement sheet 26 to be moved into the overlying position without interference. Use of the short disbursement sheets 26 provides the advantage of minimizing the amount of duplicative columnar headings.

Figure 7:
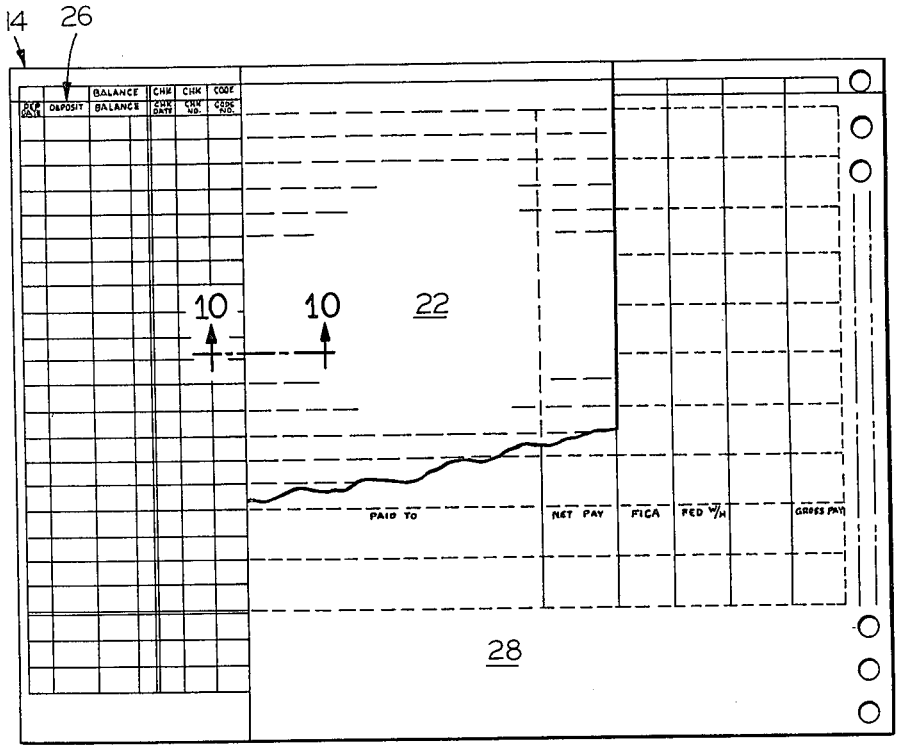
FIG. 7 is a view similar to FIG. 6 wherein the voucher sheet has also been pivoted from the right hand side to the left hand side land showing the transfer sheet partially broken away for clarity of illustration.

Turning now to FIG. 7, the voucher sheet 28 has also been brought to the left hand side of the ledger and overlies both the short disbursement sheet 26 and the base disbursement sheet 14.

Figure 10:
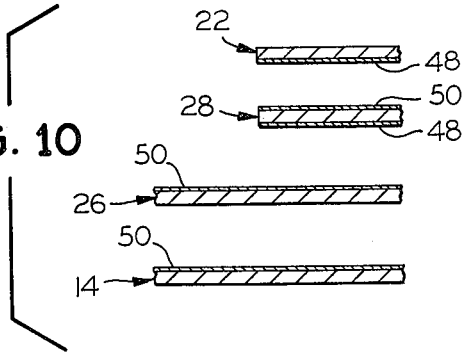
FIG. 10 is a fragmentary sectional view of the assembly of FIG. 7 along the line 10—10 and drawn to an enlarged scale and exploded.

Turning now to FIG. 10, it can be seen that the inner surface of the transfer sheet 22 and the inner surface of the voucher sheet 28 are provided with coatings 48 of a first ink reactant whereas the outer surface of the voucher sheet 28 and the outer surfaces of the disbursements sheets 14, 26 are provided with coatings 50 of a second ink reactant. When pressure is applied by a pen or other like implement (not shown) through the aperture 44 of the shield member 30, the reactive coatings 48, 50 will interact to produce an ink image upon the voucher sheet 28 and disbursement sheet 26 (or disbursement sheet 14 in the event that the transfer sheet 22 or voucher sheet 28 is in direct contact therewith).

Figure 8:
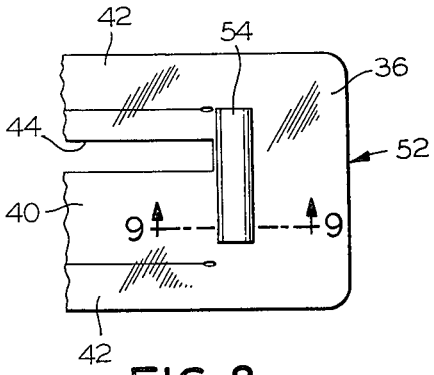
FIG. 8 is a fragmentary plan view of an alternate embodiment of the shield member.
Figure 9:
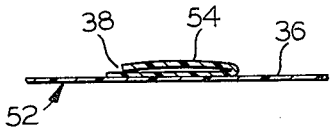
FIG. 9 is a fragmentary sectional view of the shield member of FIG. 8 along the line 9—9 and drawn to an enlarged scale.

Turning now to FIGS. 8 and 9, an alternate embodiment of the shield member is therein illustrated and generally designated by the number 52. In this embodiment, the base of synthetic plastic sheet material is unfolded and a separate folded strip 54 of synthetic plastic is adhered to the surface thereof on the check positioning portion 36 to provide the abutment clamp 38.

For convenience and clarity of illustration, the titles or headings of the various columns of the disbursements sheets 14, 26 and voucher sheet 28 have not been fully shown. In the present invention, the transfer sheet 22 overlies a column of relatively large width designating the payee of the check or to whom a disbursement is made, and immediately to the right thereof, a column designating the amount disbursed, i.e., "Payee" and "Amount Disbursed" columns. When an assembly including a voucher sheet 28 is employed, the columns of the disbursements sheets 14, 26 extending to the right thereof will, of course, correspond to the data on the right hand side of the voucher sheet 28.

When voucher sheets 28 are employed, these are generally provided with transverse perforations so that they may be severed into a series of strips with the appropriate strip accompanying the related check. Moreover, the voucher sheet utilization may desirably employ two lines of underlying ledger sheets 14, 26 as will be pointed out more fully hereinafter.

Turning now to operation of the bookkeeping ledger assembly of the present invention, the transfer sheet 22 is unfolded from the storage position shown in full line in FIG. 1 to the work position shown in FIGS. 3–7 so that it overlies substantially the entire length of the disbursement sheet 14 (or short disbursement sheet 26) and its bottom edge is fastened in this position by the clip 24. The shield member 30 is then placed in position by sliding the shield portion 40 thereof under the transfer sheet 22 while the positioning arms 42 extend above the transfer sheet 22, all as shown in FIG. 3. Movement of the shield member 30 relative to the transfer sheet 22 and disbursement sheet 14 will be limited by the right hand ends of the slits which separate the shield position 40 from the positioning arms 42.

Figure 4:
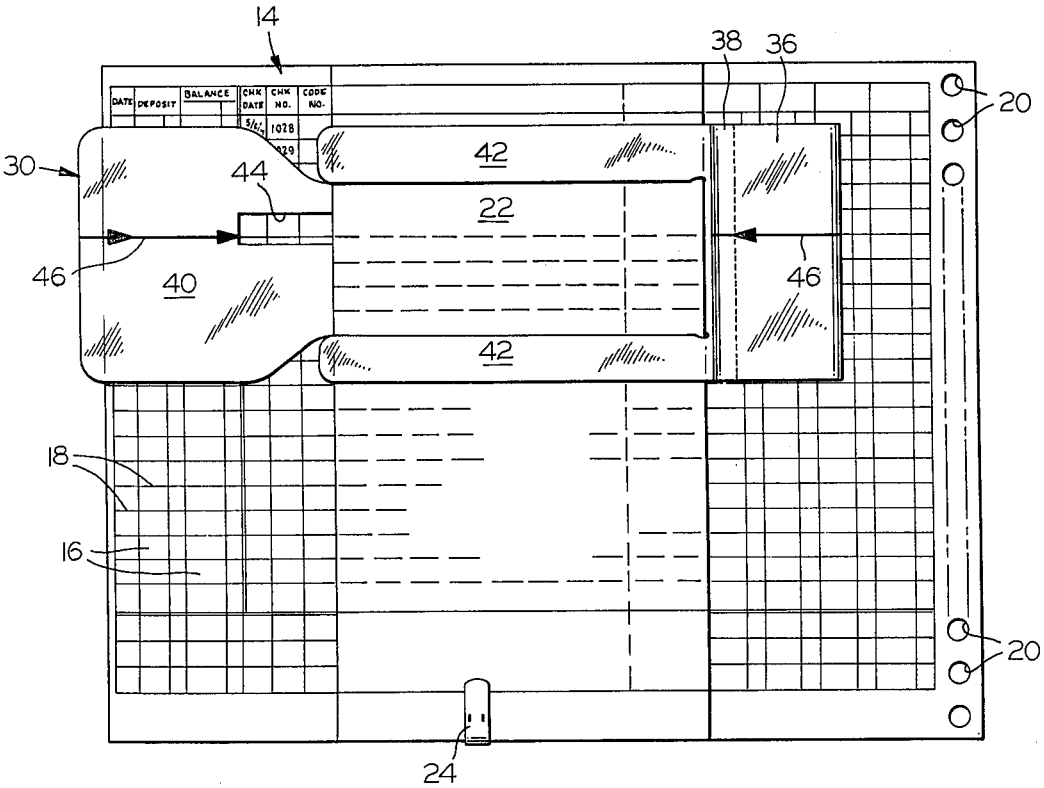
FIG. 4 is a plan view of the subassembly of FIG. 3 with the shield member in operative position.
Figure 5:
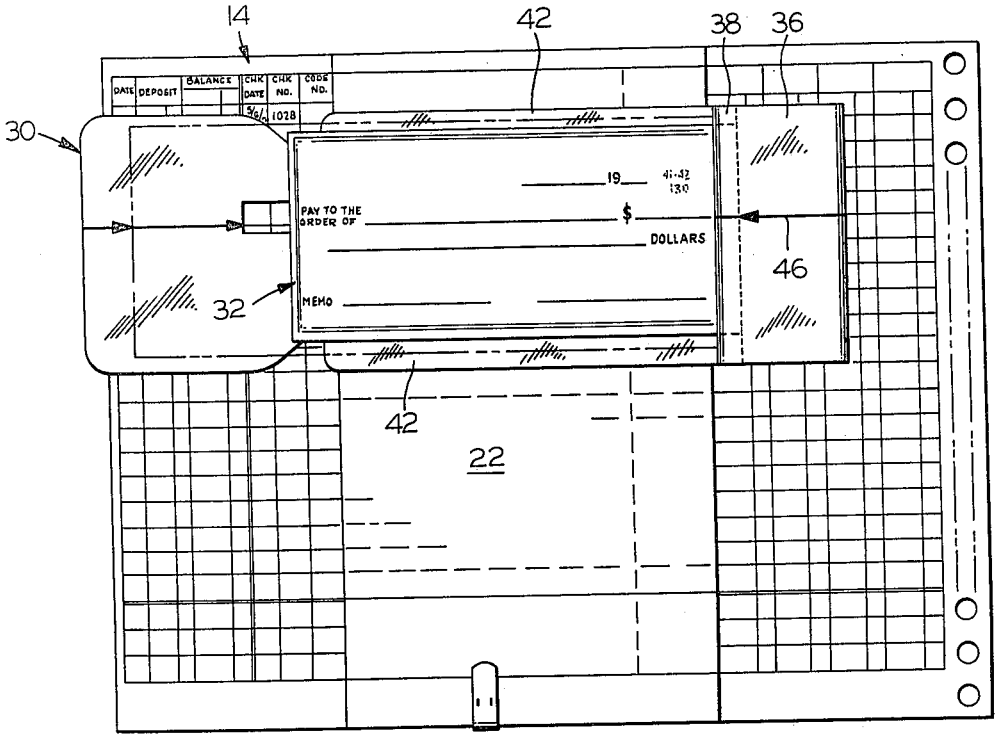
FIG. 5 is a view similar to FIG. 4 showin a check positioned upon the shield member.

The shield member 30 is slid along the surfaces of the transfer sheet 22 and disbursement sheet 14 until the alignment indicia 46 thereon are aligned with the bottom of the line of the disbursement sheet 14 on which entries are to be made, as shown in FIG. 4. The commercially available check 32 is then placed upon the shield 30 and its right hand edge extends into the clamp 38 of the check positioning portion 36, and the bottom lines for the payee and numerical value of the disbursement are aligned with the alignment indicia 46. At this point, the check may be filled out and, as the name of the payee and numerical value is entered thereon, that data will be entered onto the underlying disbursement sheet 14 by reason of the reaction of the coatings 48, 50. However, the pressure of the writing implement in applying data to other portions of the check is sufficiently diffused by the shield member 30 that the reactive coatings 48, 50 are not activated so that this data is not transferred to the disbursement sheet 14.

In FIG. 6, the short disbursement sheet 26 has been pivoted into a position overlying the base disbursement sheet 14 so that the major columnar headings on the base disbursement sheet 14 are exposed and need not be repetitively copied. In FIG. 7, the voucher sheet 28 has also been pivoted into position and the transfer sheet 22 then placed thereover. In this assembly, there are four additional columns available on the voucher sheet for entry of other data concurrently upon the voucher sheet and upon the disbursement sheet 14. In using this particular assemblage, the shield member is positioned as in FIGS. 4 and 5 and the desired data to complete the check is entered upon the check 32, which results in simultaneous entry of the data relative to payee and numerical amount disbursed on both the voucher sheet 28 and the disbursement sheet 26. The shield member 30 and check 32 are then removed and the transfer sheet 22 may or may not be pivoted into a noninterfering position depending upon whether additional information is to be recorded in the two columns which are overlain thereby. With the shield member removed, additional entries are made in the four right hand columns of the voucher sheet 28 which simultaneously records the information in the columns of the underlying disbursement sheet 26. Such information, for example, may include gross pay, FICA and withholding taxes, overtime, etc. Following completion of all or a portion of the voucher sheet 28, it may be severed along the transverse perforations and each strip coupled to the check which corresponds thereto to provide additional data to the payee or for processing purposes.

Figure 11:
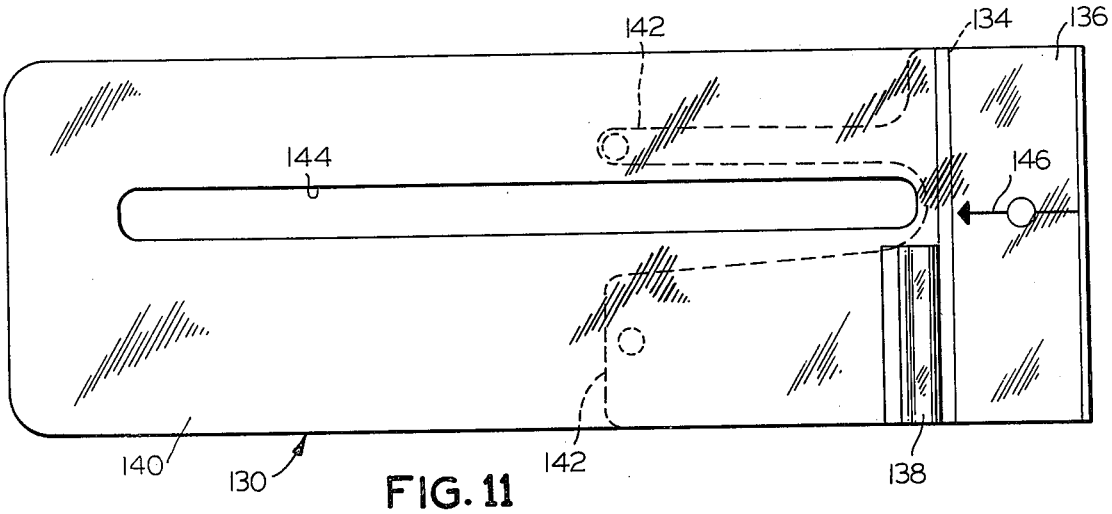
FIG. 11 is a plan view of another embodiment of shield member showing the positioning arms on phantom line.
Figure 12:
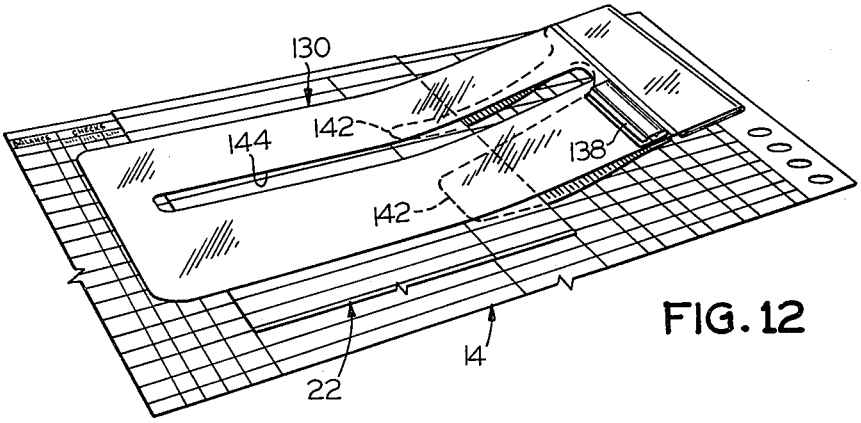
FIG. 12 is a fragmentary perspective view of the shield member of FIG. 11 being inserted into assembly with a transfer sheet and disbursement sheet.
Figure 13:
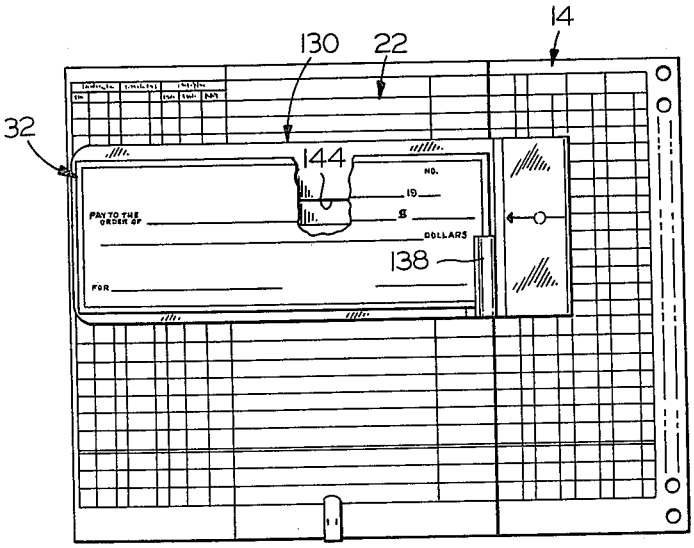
FIG. 13 is a plan view of the assembly of FIG. 11 with a check positioned upon the shield member and partially broken away to reveal underlying structure.

Turning now to FIGS. 11–13, therein illustrated is another embodiment of shield member generally designated by the number 130 formed from two plies heat sealed along the line 134 to provide a check positioning portion 136 along the folded end portion. One ply provides an elongated shield portion 140 with an elongated aperture 144 therein; the other ply is cut two provide two positioning arms 142. An alignment indicium 146 is provided on the check positioning portion 136 in alignment with the aperture 144. A spring clamp 138 of synthetic plastic material is heat sealed upon the check positioning portion to receive the edge portion of the check 32 as seen in FIG. 13.

In using this embodiment, the positioning arms 142 extend between the transfer sheet 22 and disbursement sheet 14, and the shield portion 140 is disposed above the transfer sheet 22. Thus, the positioning arms 142 guide the shield member 130 as it is moved along the transfer sheet 22.

As hereinbefore indicated, the shield member is most desirably fabricated from flexible synthetic plastic sheet material so as to facilitate its handling during the process of assembling and disassembling. However, a rigid member may be employed if so desired. For convenience in movement and placement, the synthetic plastic sheet material is desirably transparent and the indicia thereon may be provided by printing, etching, or any other suitable means.

The dimensioning of the shield member is not critical so long as its length and width are sufficient to encompass that portion of the check blank onto which data will be recorded although different shield members may be provided for use with small checks and large checks. Conveniently, a single shield member may be employed for either size of standard commercial check blank. The aperture therein, of course, must be sufficient to extend for the length of the payee and numerical disbursement blanks of the check. As a specific example of the dimensioning of a shield member usable for both small and large size check blanks, a strip of plastic material approximately 13 inches by $3\frac{1}{2}$ inches was employed to produce a folded shield member of the type illustrated in FIGS. 1–3 of the attached drawings. The right hand portion was reversely folded at about $10\frac{1}{4}$ inches and then folded in again upon itself to provide the folded check positioning portion shown in the drawings, this portion having a total length of about $1\frac{3}{4}$ inches. At a distance of $\frac{1}{4}$ inch from the inner fold, the several plies of the strip were secured together by stitching, thus providing the clamp portion and the abutment surface for the right hand edge of the check.

Two elongated cuts were made from adjacent the check positioning portion to provide positioning arms extending for $5\frac{1}{4}$ inches, the upper positioning arm having a transverse dimension of $\frac{3}{4}$ inch and the lower positioning arm having a transverse dimension of $\frac{5}{8}$ inch. As can be seen, the cuts terminate in an accurate portion to prevent further elongation and minimize the stresses that would otherwise occur during constant flexure. As can be seen, the strip material at the ends of the positioning arms was cut away to provide clearance and facilitate movement of the shield portion. The aperture in this embodiment has a dimension of $6\frac{1}{4}$ inches by $\frac{3}{8}$ inch with its upper edge being spaced downwardly from the upper edge of the shield member a distance of $1\frac{1}{4}$ inches. Such a shield member has been found highly satisfactory for both sizes of commercially available checks.

The voucher sheets are preferably made from a perforated paper stock so that the individual voucher strips may be readily severed after writing the check and clipped to the check. Alternatively, a page of checks may be written and the voucher sheet removed and cut mechanically.

Instead of the voucher sheet embodiment of the duplicate sheet, or in addition thereto, a duplicate journal sheet may be provided within the writing assembly on the left hand side of the ledger, and similarly provided with the reactive coatings. Thus, in a simple operation, the payee and numerical amount disbursed may be simultaneously entered upon the voucher and/or duplicate journal sheet, and upon the basic journal sheet. Moreover, the shield member and check may be removed so that additional entries may be made upon the remaining sheets of the assembly. When a duplicate journal sheet is employed, it, like the voucher sheet, must have its upper surface coated with the one reactant, and its lower surface coated with the second reactant ink material.

As will be readily appreciated, the bookkeeping ledger system of the present invention may be used with standard commercial checks. Although these may be supplied in a perforated strip form, it is just as convenient, if not more convenient, to use individual checks. The checks may be of small personal size or of the larger commercial size as previously indicated, the only requirement being that the shield member aperture be sufficiently large to encompass the larger space provided for the payee and numerical disbursement blanks on a commercial check.

Carbon paper may be inserted between the transfer sheet and disbursement sheet or between the transfer, voucher and disbursement sheets to effect the recordation of the data in response to a writing implement. However, a preferred assembly is that illustrated in the drawings wherein the opposing surfaces are coated with reactive inks which will, upon application of pressure by ball point pen or the like, interact and produce the desired image on the underlying document. Thus, the transfer sheet and voucher sheet are coated on their lower surfaces with one reactive component and the ledger sheets and the top of the voucher sheet are coated with the other reactive component.

Thus, it can be seen from the foregoing detailed specification and the attached drawings that the bookkeeping ledger system of the present invention is relatively simple to fabricate and utilize and enables simultaneous entry of payee and numerical amounts disbursed on a check and on underlying bookkeeping records, while at the same time preventing recordation of additional data entered on the check. The assembly permits utilization of standard commercial checks of either large or small size and does not require any special shingling of the checks. Moreover, the system of the present invention permits simultaneous preparation of individual check voucher strips to accompany the checks. The method of utilization of the system is extremely simple and rapid so as to minimize the amount of time required for recording check data and the possibility of error.

Having thus described the invention, we claim:

1. In a bookkeeping and check writing system, the combination comprising:

a. a disbursement sheet having length and width dimensions, the width dimension being divided into a multiplicity of columns and the length dimension providing a mulitplicity of lines, two columns being dimensioned cooperatively with commercial checks to record the name of the payee and the numerical amount entered on the checks; and b. a transfer sheet of lesser width than said disbursement sheet and overlying said two columns of said disbursement sheet; and c. means releasably securing said transfer sheet in said overlying position; and d. a shield member having a check positioning portion disposed to one side of said transfer sheet and a shield portion extending therefrom above said disbursement sheet, said shield portion being of a length at least substantially equal to the portion of a check containing blanks for completion and having an elongated aperture therein extending transversely of said transfer sheet and across said two columns of said disbursement sheet, said positioning portion having an alignment indicium thereon aligned with said aperture, said shield member being adapted to position a check on said transfer sheet with its payee and numerical disbursement portions aligned with said indicium and thereby said two columns of said disbursement sheet on one of the lines thereof, said shield member being movable vertically from line to line thereof, whereby when a check is placed thereon and written only the payee and numerical amount disbursed are entered on one line of said disbursement sheet.

2. The bookkeeping and check writing system of claim 1 wherein said shield member includes a pair of positioning arms extending from said positioning portion and overlying said disbursement sheet, said positioning arms being spaced apart a distance greater than the portion of a check containing blanks for completion, one of said shield portion and said positioning arms overlying the transfer sheet and the other extending between said disbursement sheet and transfer sheet to retain said shield in position on said transfer sheet.

3. The bookkeeping and check writing system of claim 1 wherein said shield portion is of greater width than said transfer sheet and extends beyond the opposite side thereof, the portion thereof spaced beyond the opposite side thereof including an alignment indicium aligned with said alignment indicium of said positioning portion.

4. The bookkeeping and check writing system of claim 1 wherein said shield member is transparent and slidable along said transfer sheet and disbursement sheet to bring said shield member into alignment with any of the lines of said disbursement sheet.

5. The bookkeeping and check writing system of claim 1 wherein said shield member has a clamping portion extending parallel to said columns on said positioning portion thereof to receive and releasably retain one side edge of a check.

6. The bookkeeping and check writing system of claim 1 wherein said shield member is integrally formed from a strip of synthetic plastic sheet material, one side thereof being folded to provide said positioning portion including a clamping portion and abutment surface for one side edge of the check.

7. The bookkeeping and check writing system of claim 1 wherein said shield member includes a base element providing said shield and positioning portions and a clamp element secured to the outer surface of the positioning portion providing an abutment surface and clamp for one side edge of the check.

8. The bookkeeping and check writing system of claim 1 wherein there is additionally included a duplicate sheet interposed between said transfer sheet and said disbursement sheet, said shield portion of said shield member extending between said transfer sheet and said duplicate sheet.

9. The bookkeeping and check writing system of claim 8 wherein said duplicate sheet is severable transversely to provide voucher slips to be supplied with the checks corresponding to the entries thereon.

10. The bookkeeping and check writing system of claim 8 wherein said disbursement, duplicate and transfer sheets have reactive coatings on the opposed surfaces thereof, said coatings being activated by the pressure of a writing implement to transfer the data entered on the associated check onto the disbursement sheet.

11. The bookkeeping and check writing system of claim 1 wherein said disbursement and transfer sheets have reactive coatings on the opposed surfaces thereof, said coatings being activated by the pressure of a writing implement to transfer the data entered on the associated check onto the disbursement sheet.

12. In a method for simultaneously writing checks and recording data on a disbursement sheet, the steps comprising:

a. providing a disbursement sheet divided into a multiplicity of columns with two columns being dimensioned cooperatively with the dimensions of commercial checks to record the name of the payee and the numerical amount entered on the checks;

b. securing a transfer sheet over said two columns of said disbursement sheet;

c. positioning a shield member on said transfer sheet and disbursement sheet with a shield portion thereon extending above said disbursement sheet, said shield portion having an elongated aperture therein extending transversely of said transfer sheet and across said two columns of said disbursement sheet, said shield member also having a check positioning portion spaced to one side of said transfer sheet, said shield portion being movable vertically above said disbursement sheet to align said aperture with the line of said disbursement sheet onto which data is to be entered;

d. positioning on said shield member a check with its payee and numerical disbursement blanks aligned with said aperture of said shield portion and said two columns of said disbursement sheet; and e. thereafter entering data onto said check to complete at least the payee and numerical disbursement blanks thereof, said data entered in said payee and numerical disbursement blanks being simultaneously entered in said two columns of said disbursement sheet, said shield portion substantially preventing recordation of other data entered onto said check.

13. A method in accordance with claim 12 including the additional steps of removing the completed check;

moving said shield member downwardly into alignment with another line on said disbursement sheet;

positioning on said shield member another check so that its payee and numerical disbursement blanks are aligned with said aperture of said shield portion and said two columns of said disbursement sheet; and thereafter entering data onto said another check to complete at least the payee and numerical disbursement blanks thereof with the data entered in said blanks being simultaneously entered in the underlying two columns of said disbursement sheet.

14. A method in accordance with claim 12 wherein the step of positioning said shield member includes the positioning of arm portions on said shield member on the opposite surface of said transfer sheet from said shield portion.

15. A method in accordance with claim 12 including the additional step of placing a duplicate sheet between said transfer sheet and said disbursement sheet, the entering of said data onto said check simultaneously entering the data on both said duplicate sheet and said disbursement sheet.

16. A method in accordance with claim 15 including the additional steps of removing the shield member and check and entering additional data onto said duplicate sheet, said data entered onto said duplicate sheet being simultaneously entered into the underlying columns of said disbursement sheet.

17. A method in accordance with claim 16 wherein said duplicate sheet is severed across its width to provide a strip containing data relative to the associated check.

18. A method in accordance with claim 12 wherein said shield member includes a clamping portion on said check positioning portion and wherein the edge of said check is inserted into and clamped in said clamping portion.

* * * * *